US006912998B1

(12) United States Patent
Rauznitz et al.

(10) Patent No.: US 6,912,998 B1
(45) Date of Patent: Jul. 5, 2005

(54) PIEZOELECTRIC FUEL INJECTION SYSTEM WITH RATE SHAPE CONTROL AND METHOD OF CONTROLLING SAME

(75) Inventors: Peter Rauznitz, Columbus, IN (US); John D. Crofts, Edinburgh, IN (US); Lester L. Peters, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 10/796,068

(22) Filed: Mar. 10, 2004

(51) Int. Cl.[7] ..... F02M 51/00

(52) U.S. Cl. ..... 123/490; 123/496; 701/104; 310/316.01; 239/102.2

(58) Field of Search ..... 123/490, 478, 123/480, 496, 467, 446; 701/104, 105; 310/316.01, 317; 239/102.2

(56) References Cited

U.S. PATENT DOCUMENTS 4,022,166 A * 5/1977 Bart ..... 239/584
5,057,734 A 10/1991 Tsuzuki et al.
5,165,373 A * 11/1992 Cheng ..... 123/300
5,694,903 A 12/1997 Ganser
5,779,149 A 7/1998 Hayes, Jr.
5,819,704 A 10/1998 Tarr et al.
5,860,597 A 1/1999 Tarr
6,062,489 A 5/2000 Tokumaru
6,062,533 A 5/2000 Kappel et al.
6,082,332 A 7/2000 Hefler et al.
6,196,472 B1 3/2001 Cooke
6,213,089 B1 * 4/2001 Cheng ..... 123/300
6,213,098 B1 4/2001 Kato et al.
6,253,736 B1 7/2001 Crofts et al.
6,296,197 B1 10/2001 Boecking
6,308,689 B1 10/2001 Augustin
6,499,467 B1 12/2002 Morris et al.
6,557,530 B1 5/2003 Benson et al.
6,557,776 B2 5/2003 Carroll, III et al.
6,760,212 B2 * 7/2004 Cheever et al. ..... 361/160
2003/0205949 A1 * 11/2003 Rueger et al. ..... 310/316.03

* cited by examiner

*Primary Examiner*—John T. Kwon
(74) *Attorney, Agent, or Firm*—Nixon Peabody LLP; Tim L. Brackett, Jr.; J. Bruce Schelkopf

(57) ABSTRACT

A piezoelectric fuel injection system and a method of controlling same, the system including a piezoelectric fuel injector having a piezoelectric element, a power source adapted to provide power to the piezoelectric element to actuate the piezoelectric fuel injector, and a controller adapted to cyclically modulate power provide to the piezoelectric element by the power source during at least a portion of the injection event. The controller cyclically modulates the power between a predetermined first voltage and a predetermined second voltage that is less than the first voltage to control the rate of fuel injected by the piezoelectric fuel injector during the portion of the injection.

35 Claims, 4 Drawing Sheets

PIEZOELECTRIC FUEL INJECTION SYSTEM WITH RATE SHAPE CONTROL AND METHOD OF CONTROLLING SAME

BACKGROUND OF THE INVENTION

1. Field of the Invention

The present invention is directed to piezoelectric injection systems having a mechanism for controlling rate shape, and to methods for controlling such piezoelectric injection systems.

2. Description of Related Art

In most fuel supply systems applicable to internal combustion engines, fuel injectors are used to inject fuel pulses into the engine combustion chamber. A commonly used injector is a closed-nozzle injector which includes a nozzle assembly having a spring-biased nozzle valve element positioned adjacent the nozzle orifice for allowing fuel to be injected into the cylinder. The nozzle valve element also functions to provide a deliberate, abrupt end to fuel injection thereby preventing a secondary injection which causes unburned hydrocarbons in the exhaust. The nozzle valve is positioned in a nozzle cavity and biased by a nozzle spring so that when the pressure of the fuel within the nozzle cavity exceeds the biasing force of the nozzle spring, the nozzle valve element moves outwardly to allow fuel to pass through the nozzle orifices, thus marking the beginning of the injection event.

In another type of system, such as disclosed in U.S. Pat. No. 5,819,704, the beginning of injection event is controlled by a servo-controlled needle valve element. The system includes a control volume positioned adjacent an outer end of the needle valve element, a drain circuit for draining fuel from the control volume to a low pressure drain, and an injection control valve positioned along the drain circuit for controlling the flow of fuel through the drain circuit so as to cause the movement of the needle valve element between open and closed positions. Opening of the injection control valve causes a reduction in the fuel pressure in the control volume resulting in a pressure differential which forces the needle valve open, and closing of the injection control valve causes an increase in the control volume pressure and closing of the needle valve.

Internal combustion engine designers have increasingly come to realize that substantially improved fuel supply systems are required in order to meet the ever increasing governmental and regulatory requirements of emissions abatement and increased fuel economy. Specifically, it is known that improved control of fuel metering into the combustion chamber, is essential in reducing the level of emissions generated during combustion process while minimizing fuel consumption, for example, in combustion of diesel fuel. In addition, it is known that improved control of the rate of fuel injected during the course of an injection event, i.e. the rate shape of the injection, is also very important in reducing the level of emissions generated, especially in diesel fuel combustion. As a result, many proposals have been made to provide fuel metering control and rate shape control for closed nozzle fuel injector systems, including such systems that utilize piezoelectric fuel injectors.

For instance, U.S. Pat. No. 5,779,149 to Hayes, Jr. discloses a piezoelectric controlled common rail fuel injector. The piezoelectric actuator controls the movement of an inwardly opening poppet-type control valve for controlling the flow of fuel from a control volume and ultimately, the movement of the nozzle valve element. The reference further discloses that fuel metering is variably controlled by controlling the duration and modulation of the electrical signal that is provided to the piezoelectric actuator. Although the above described reference provides some control over fuel metering, and thus, control over the amount of fuel injected, the reference does not provide a solution for effectively controlling rate shape of the fuel injections.

U.S. Pat. No. 6,253,736 to Crofts et al. discloses a piezoelectric fuel injector nozzle assembly having feedback control with a nozzle valve control arrangement that operates to control the movement of the nozzle valve element. The reference discloses that the nozzle valve control arrangement functions to control the quantity of the fuel metered, and also functions as a rate shaping control device for producing a predetermined time varying change in the flow rate of fuel injected into the combustion chamber during an injection event so as to improve combustion and minimize emissions. The reference further discloses that the injection rate shape is controlled by varying the voltage supplied to the piezoelectric actuator based on engine operating conditions.

Methods of controlling fuel injectors such as that disclosed in Crofts et al. typically provide an input signal, i.e. voltage, current, etc., to a piezoelectric element, an electromagnetic actuator, or a magnetostrictive actuator to thereby operate the fuel injector. As disclosed in Crofts et al., rate shape of fuel injections is also controlled in the same manner by changing the magnitude of the input signal. However, controlling the rate shape of fuel injections by varying the input signal in the manner known has been found to not provide the desired results in various instances when accurate rate shaping would be desirable.

Thus, despite the teachings of Crofts et al., alternative systems and methods for controlling injection rate shape using piezoelectric fuel injectors are desirable to provide further control of combustion and emissions generated by such combustion, and to further improve fuel economy. Therefore, there still exists an unfulfilled need for a piezoelectric fuel injection system having enhanced rate shape control, and a method for controlling a piezoelectric fuel injector in which enhanced rate shape is attained.

SUMMARY OF THE INVENTION

In view of the foregoing, an aspect of the present invention is a piezoelectric fuel injection system to aid in reducing exhaust emissions and improving fuel economy.

Another aspect of the present invention is a piezoelectric fuel injection system having enhanced rate shape control.

Still another aspect of the present invention is a method for controlling a piezoelectric fuel injection system in which enhanced rate shape is attained.

Thus, in accordance with one aspect of the present invention, a piezoelectric fuel injection system for an internal combustion engine is provided for allowing control of injection rate shape during an injection event. In one embodiment, the piezoelectric fuel injection system comprises a piezoelectric element actuable to inject fuel during the injection event, a power source adapted to provide power to the piezoelectric element, and a controller adapted to switch the power source on to begin the injection event, and to cycle the power source a plurality of times during at least a portion of the injection event, each cycle including switching the power source off, and switching the power source back on. The piezoelectric fuel injection system thus provides cyclical power to the piezoelectric element during the injection event to control the rate of injected fuel during the portion of the injection event, for example, to gradually increase or gradually decrease the rate of fuel injected.

In accordance with another embodiment, the controller is further adapted to terminate cycling of the power source with the power source switched back on so as to provide constant power to the piezoelectric element for a desired duration so that rate of injected fuel is substantially constant for the duration. In still another embodiment, the portion of the injection event during which the power source is cycled plurality of times by the controller is at an early stage of the injection event.

In accordance with yet another embodiment of the present invention, the controller is further adapted to switch the power source off and back on at a rate that is quicker than the response time of the nozzle valve element of the fuel injector. In this regard, the controller is adapted to switch the power source off and back on in less than 500 micro-seconds so that at least one cycle is attained in less than 500 micro-seconds, for example, less than 250 micro-seconds.

In still another embodiment of the present invention, the piezoelectric fuel injection system comprises a piezoelectric fuel injector actuable to inject fuel during the injection event, the piezoelectric fuel injector having a piezoelectric element, a power source adapted to provide power to the piezoelectric element to actuate the piezoelectric fuel injector, and a controller adapted to cyclically modulate power provided to the piezoelectric element by the power source during at least a portion of the injection event. In this embodiment, the controller cyclically modulates the power between a predetermined first voltage and a predetermined second voltage that is less than the first voltage to control the rate of fuel injected by the piezoelectric fuel injector during the portion of the injection event.

In yet another embodiment of the present invention, the piezoelectric fuel injection system comprises a fuel injector actuable to inject fuel during an injection event, the fuel injector having a piezoelectric element, and a controller adapted to operate the fuel injector in a cycling stage and a steady state stage. In the cycling stage, power provided to the piezoelectric element during at least a portion of the injection event is repeatedly switched between a predetermined first voltage and a predetermined second voltage less than the first voltage to control the rate of fuel injected by the fuel injector. In the steady state stage, power provided to the piezoelectric element is substantially steady at the predetermined constant voltage for a determined duration so that rate of fuel injected by the fuel injector is substantially constant for the duration.

In accordance with another aspect of the present invention, a method is provided for controlling a piezoelectric fuel injection system for an internal combustion engine having a piezoelectric fuel injector adapted to inject fuel during an injection event of a combustion cycle. In one embodiment, the method comprises the steps of providing a voltage to the piezoelectric fuel injector to begin the injection event, terminating the voltage to the piezoelectric fuel injector, again providing the voltage to the piezoelectric fuel injector, and repeatedly terminating and providing the voltage to the piezoelectric fuel injector during at least a portion of the injection event to control the rate of fuel injected by the piezoelectric fuel injector during the portion of the injection event.

In one embodiment, the method also includes the step of continuously providing the voltage to the piezoelectric fuel injector during the injection event after the step of repeatedly terminating and providing a constant voltage for a desired duration to the piezoelectric fuel injector so that the piezoelectric fuel injector injects fuel at a substantially constant rate for the duration. In another embodiment, the portion of the injection event during which the step of repeatedly terminating and providing the voltage to the piezoelectric fuel injector is at an early stage of the injection event.

In accordance with another embodiment, repeatedly terminating and providing the voltage to the piezoelectric fuel injector is attained at a rate that is faster than the response time of the nozzle valve element of the fuel injector. In still another embodiment, the step of repeatedly terminating and providing the voltage to the piezoelectric fuel injector includes the step of terminating the voltage within less than 500 micro-seconds, preferably within less than 250 micro-seconds, of providing the voltage.

In still another embodiment, a method of controlling a piezoelectric fuel injection system is provided, the method comprising the steps of providing a voltage to the piezoelectric fuel injector, and cyclically modulating the voltage that is provided to the piezoelectric fuel injector between a predetermined first voltage and a predetermined second voltage during at least a portion of the injection event to thereby control rate of fuel injected by the piezoelectric fuel injector during the portion of the injection event.

These and other aspects of the present invention will become more apparent from the following detailed description of the preferred embodiments of the present invention when viewed in conjunction with the accompanying drawings.

DETAILED DESCRIPTION OF THE PREFERRED EMBODIMENT

Figure 1:
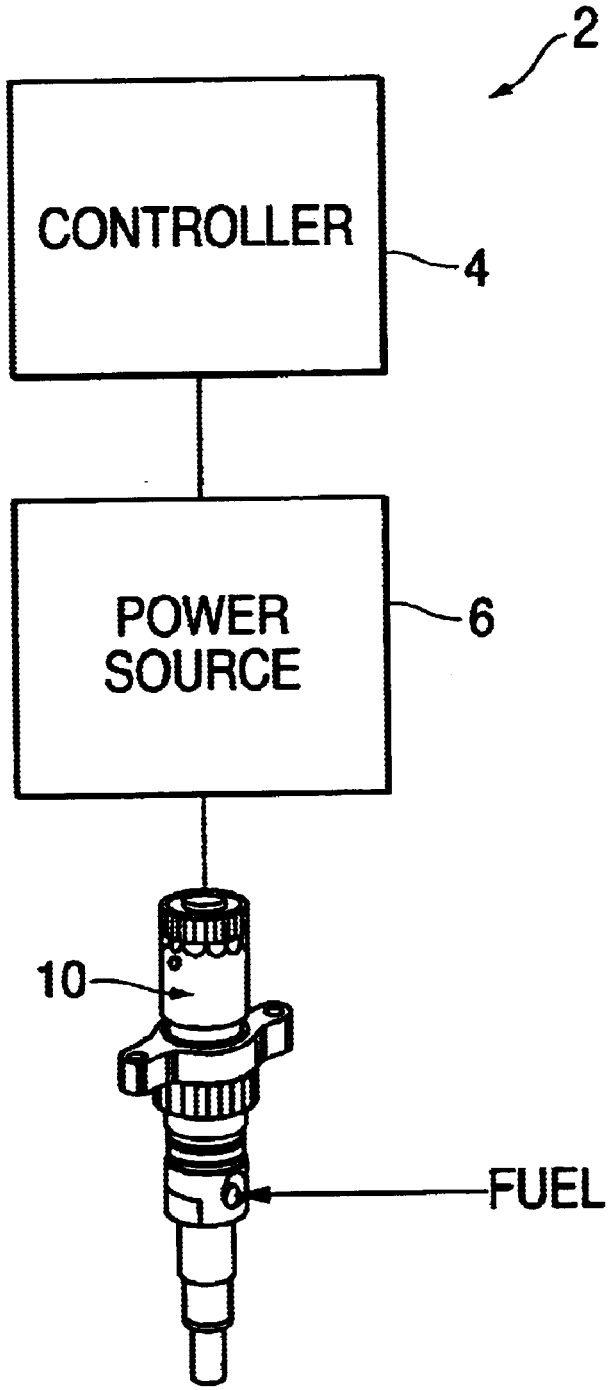
FIG. 1 is a schematic illustration of a piezoelectric fuel injection system in accordance with one embodiment of the present invention.

FIG. 1 shows a schematic illustration of a piezoelectric fuel injection system 2 in accordance with one embodiment of the present invention that avoids the above noted limitations of conventional fuel injection systems. As described in further detail below, the piezoelectric fuel injection system 2 allows enhanced control of the rate of fuel injected during an injection event of a combustion cycle in an internal combustion engine, for example, a diesel engine, so that the rate shape can be effectively controlled. Of course, the present invention may also be applied to other types of internal combustions as well.

The piezoelectric fuel injection system 2 of the illustrated embodiment includes a controller 4 that is connected to a power source 6, the controller 4 being adapted to control the power source 6. The power source 6 of the piezoelectric fuel injection system 2 is connected to a fuel injector 10 and provides power thereto in the manner as further described below in accordance with the present invention. The fuel injector 10 receives fuel from a fuel source and is adapted to inject the received fuel into a combustion chamber of an internal combustion engine (not shown) during an injection event of a combustion cycle, details of the internal combustion engine and combustion cycles being known in the art and thus, being omitted herein.

Figure 2A:
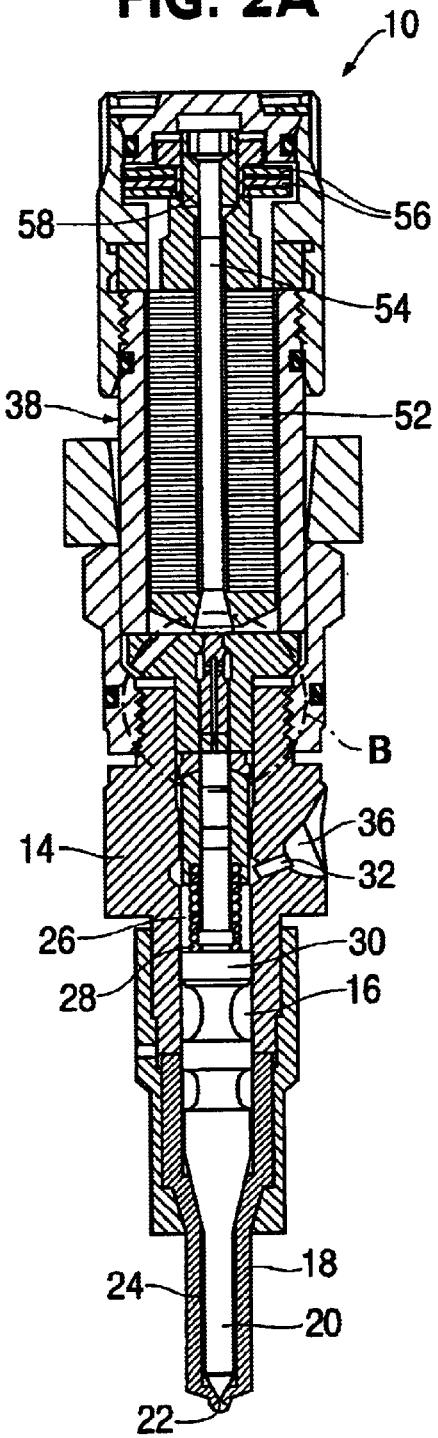
FIG. 2A is a cross sectional view of a piezoelectric fuel injector of the piezoelectric fuel injection system of FIG. 1 in accordance with one embodiment.
Figure 2B:
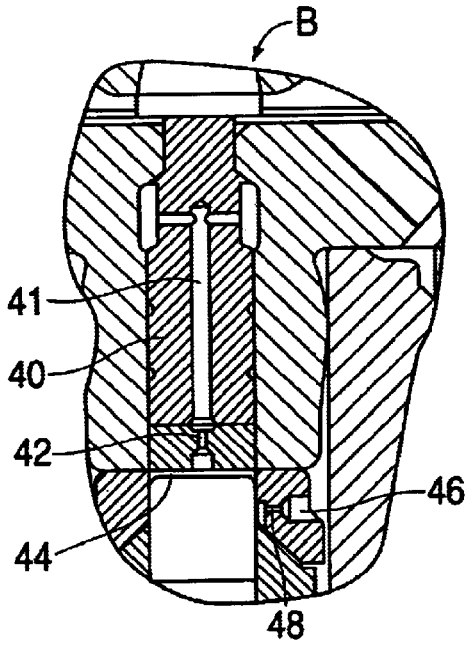
FIG. 2B is an enlarged cross sectional view of the metering valve of the piezoelectric fuel injector of FIG. 2A.

Referring to FIGS. 2A and 2B, a cross-sectional view of the fuel injector 10 of FIG. 1 is shown which is utilized in the implementation of the piezoelectric fuel injection system 2 in accordance with one example embodiment. As explained in detail below, the fuel injector 10 functions to effectively permit accurate and variable control of fuel metering while also providing injection rate shaping in accordance with the present method. It should be initially noted that whereas specific details regarding the structure of the fuel injector 10 are shown in FIGS. 2A and 2B and discussed herein, the fuel injector 10 is merely one example implementation thereof and other appropriately designed injectors may be utilized in the implementation of the present invention.

As can be appreciated by one of ordinary skill in the art by examination of FIG. 2A, the fuel injector 10 is a closed nozzle type that is commonly utilized in high pressure common rail or a pump-line-nozzle systems. For example, U.S. Pat. No. 6,253,736 to Crofts et al. which is incorporated herein by reference, discloses a fuel injector similar to the fuel injector 10 shown that may be used in a high pressure fuel system. However, the system and method of the present invention may further be applied to other types of fuel injection systems utilizing other types of injectors as well.

The fuel injector 10 is comprised of an injector body 14 having a generally elongated, cylindrical shape which forms an injector cavity 16. The lower portion of fuel injector body 14 includes a closed nozzle assembly 18, which includes a nozzle valve element 20 reciprocally mounted for opening and closing the injector orifices 22, thereby controlling the flow of injected fuel into an engine combustion chamber.

The nozzle valve element 20 is preferably formed from an integral piece structure and positioned in a nozzle cavity 24 and a spring cavity 26. The spring cavity 26 contains a bias spring 28 for abutment against a land 30 formed on the nozzle valve element 20 so as to bias the nozzle valve element 20 into a closed position as shown in FIG. 2A. A fuel transfer circuit 32 is provided in the injector body 14 for supplying high pressure fuel from an inlet 36 to nozzle cavity 24 via the spring cavity 26. For example, the fuel injector 10 may be provided with high pressure fuel from a high pressure common rail or a pump-line-nozzle system.

Fuel injector 10 further includes a nozzle valve control arrangement indicated generally at 38 for controlling the movement of nozzle valve element 20 between open and closed positions, the initial opening of the nozzle valve element defining the beginning of an injection event during which fuel flows through injector orifices 22 into the combustion chamber of the internal combustion engine. Specifically, nozzle valve control arrangement 38 operates to initiate, and control the movement of nozzle valve element 20 including the degree of opening and the rate of opening of the nozzle valve element 20. In addition, the nozzle valve control arrangement 38 operates to maintain the nozzle valve element 20 in the opened position for a specified duration so as to control the quantity of fuel injected. The degree of opening, the rate of opening, and the duration of opening for the nozzle valve element 20 depend on the operating conditions of the engine, for example, engine speed, load, throttle position, etc.

When operated in accordance with the present invention, the nozzle valve control arrangement 38 controls the nozzle valve element 20 to control the rate shape of the fuel injection. This allows time varying change in the flow rate of fuel injected into the combustion chamber during an injection event. Correspondingly, such control of the rate shape allows improved fuel economy while reducing emissions.

As most clearly shown in the enlarged view of FIG. 2B, the nozzle valve control arrangement 38 in the illustrated embodiment of the fuel injector 10 includes a control valve 40 that partially defines a control volume 44. A control volume charge circuit 46 is provided with an orifice 48 for directing fuel into the control volume 44. The control valve 40 is provided with a control valve orifice 42 that is connected to a drain circuit 41 for draining fuel from the control volume 44. As shown in FIG. 2A, the control valve 40 is actuated by a piezoelectric element 52 of the nozzle valve control arrangement 38 to allow selective movement of the injection control valve 40 so as to control the amount of fuel in the control volume 44, which in turn, controls the movement of nozzle valve element 20. In this regard, the piezoelectric element 52 is operatively connected to control valve 40 via center rod 54. Furthermore, in the illustrated embodiment, the preload of the piezoelectric element 52 is adjustable via the disc springs 56 and the adjustment nut 58.

In the illustrated embodiment, the piezoelectric element 52 comprises a columnar laminated body of thin disk-shaped elements, each having a piezoelectric affect so that when a voltage is applied to the piezoelectric element 52, the elements become charged and expands along the axial direction of the column. Of course, the piezoelectric element 52 may be of any type or design in other embodiments that is suitable for actuating the control valve 40 in the manner described hereinbelow. The expansion of the piezoelectric element 52 causes draining of the fuel in the control volume 44 via the drain circuit 41 causing the opening of the nozzle valve element 20 and corresponding injection of fuel through the injector orifices 22.

The amount of expansion of the piezoelectric element 52 corresponds to the specific design of the elements, the voltage being controlled, for example, by the controller 4, and the voltage that is applied to the piezoelectric element. In addition, the duration of the voltage provided by the controller 4 determines the amount of fuel that is injected by the fuel injector 10, such duration being based on the operating conditions of the engine such as engine speed, engine load, throttle position, etc. When the voltage is turned off, i.e. zero volts is provided, the piezoelectric element 52 is discharged so that it reverts back to its original position thereby causing the control valve 40 to close the nozzle valve element 20.

Referring again to the schematic illustration of FIG. 1 and as briefly noted, the actuation and de-actuation (i.e. charging and discharging) of the piezoelectric element 52 of the nozzle valve control arrangement 38 is controlled by the controller 4. The controller 4 is preferably implemented as an electronic control unit that is adapted to precisely control the operation of the piezoelectric element 52 to thereby control the timing of injection as well as the amount of fuel that is injected during the injection event. Moreover, the controller 4 in accordance with the present invention, is further adapted to control the injection rate shape so that emissions can be reduced and fuel economy increased.

As previously described, conventional methods of controlling fuel injectors typically provide an input signal, i.e. voltage, current, etc., the magnitude of the provided input signal resulting in a fuel injection event with a particular rate shape. However, use of such conventional control methods has been found to be inadequate in accurately controlling rate shape of the injections in various situations. For example, it has been found that in order to reduce exhaust emissions in diesel engines, the rate of fuel injected into the combustion chamber during an injection event should be gradually increased to a desired steady state level instead of rapidly ramping up the rate of fuel injected to the desired steady state level at the very beginning of the injection event.

Whereas the input signal provided to the fuel injector can generally be precisely controlled to gradually change over time, such precisely controlled input signal does not necessarily result in fuel injection having the desired gradually changing rate shape. This may be attributed to the fact that although the valve control arrangement, such as the piezoelectric element, can respond to the input signal in a precise and rapid manner, the nozzle valve element 20 cannot be operated in a corresponding precise and rapid manner because the nozzle valve element 20 is operated by controlling the amount of fuel in the control volume 44 which requires time to flow into, or out, of the control volume 44. Thus, conventional fuel injectors cannot readily control the injection of fuel to achieve the desired injection rate shape. As a result, too much fuel or too little fuel can be injected into the combustion chamber by the fuel injector thereby resulting in an undesirable injection rate shape and corresponding increased emissions and/or fuel consumption.

In view of the above, the controller 4 of the piezoelectric fuel injection system 2 in accordance with the present invention is adapted to switch the power source 6 on to begin the injection event, and to cycle the power source 6 a plurality of times during at least a portion of the injection event. In one embodiment, each cycle includes switching the power source 6 off, and switching the power source 6 back on. This control of the power source 6 provides cycled power to the piezoelectric element 52, thereby charging and discharging the piezoelectric element 52 in a cyclical manner during the injection event so that rate of fuel injected by the fuel injector 10 during a portion of the injection event, such as during the early stage of the injection event, is increased in a gradual manner, or decreased during the late stage of the injection event in a gradual manner. In an example implementation, the controller 4 is adapted to switch the power source 6 off and back on in less than 500 micro-seconds so that at least one cycle is attained in less than 500 micro-seconds. Preferably, the controller 4 is adapted to switch the power source 6 off and back on in less than 250 micro-seconds. Of course, these time periods are merely examples, and the present invention is not limited thereto. For example, the present invention may be practiced by cycling the power source 6 at a rate that is faster than the response time of the nozzle valve element 20, to thereby allow creation of a floating condition.

Such repetitive, rapid cycling of the power source 6 allows accurate control of the fuel rate shape, especially when increasing or decreasing the amount of fuel injected in a gradual manner. In this regard, it should be understood that as used herein, the terms "gradual" and "gradually" refers to the fact that the injection rate changes at a slower rate than if power source 6 is not cycled in accordance with the present invention. Thus, in the application where the gradually increasing injection rate is desired, the injection rate increases at a slower rate by cycling the power source 6 as described than if power source 6 is not cycled. In the application where the gradually decreasing injection rate is desired, the injection rate decreases at a slower rate by cycling the power source 6 as described than if power source 6 is not cycled. Moreover, the controller 4 in accordance with the illustrated embodiment is further adapted to terminate cycling of the power source 6 with the power source 6 switched back on to provide a constant voltage so that the piezoelectric element 52 is not discharged and the rate of injected fuel by the fuel injector 10 is substantially constant.

It should be noted that in the embodiment described above, cycling of the power source 6 of the piezoelectric fuel injection system 2 is attained by switching the power source 6 off and on repeatedly by the controller 4. However, it should be evident to one of ordinary skill in the art that in alternative embodiments, the controller 4 may be adapted to cyclically modulate the voltage provided to the piezoelectric element 52 by the power source 6 between a predetermined first voltage and a predetermined second voltage so that rate of fuel injected by the piezoelectric fuel injector 10 during a portion of the injection event changes gradually. For example, the predetermined first voltage may be voltage sufficient to charge the piezoelectric element 52 to cause its expansion while the predetermined second voltage is less than the predetermined first voltage so as to only partially discharge the piezoelectric element 52 and to cause the contraction of the piezoelectric element 52, which in turn, causes injection of a lesser amount of fuel. In this regard, the predetermined second voltage may even be a negative voltage in other embodiments.

In addition, the cycling of the power source 6 may be terminated with the power source 6 on to thereby provide the piezoelectric element 52 with a steady voltage that is the same as the predetermined first voltage. However, other embodiments may be implemented to provide a constant voltage that is different than the predetermined first voltage. Thus, the controller 4 may be further adapted to terminate cycling of the power source 6 with the power source 6 providing a different voltage that may be more, or less than the predetermined first voltage.

The present invention may also be combined with other control strategies for controlling rate shape, such as via controlling voltage provided to the piezoelectric fuel injector. This provides further flexibility in controlling the rate shape, the present invention allowing gradual increase or decrease in the rate shape which was not readily attainable previously. In this regard, the present invention may be utilized in the manner described to allow gradual changes to the injection rate so that rate shape in a boot-shaped injection rate shape, a triangular injection rate shape, or any other desired injection rate shape may be attained.

Figure 3:
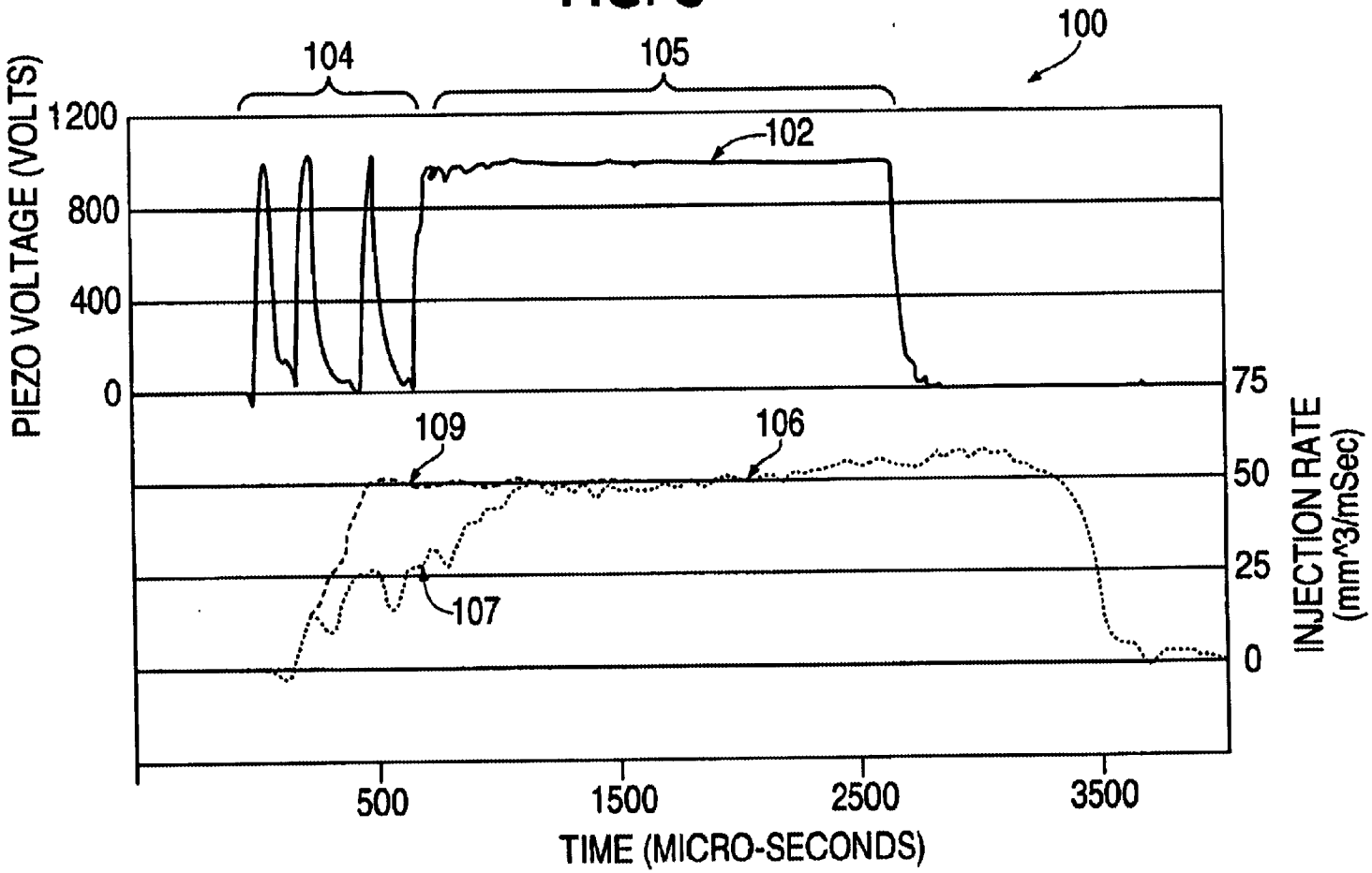
FIG. 3 is a graph illustrating voltage provided to a piezoelectric fuel injector in accordance with the present invention, and the injection rate of the piezoelectric fuel injector, versus time duration for an example injection event.

Referring to the drawings, graph 100 of FIG. 3 illustrates how the present invention described may be used and its effects. In particular, graph 100 shows the voltage that is applied to a piezoelectric fuel injector in accordance with the present invention, for example, such as that shown in FIG. 2A, and the resulting injection rate. In this regard, graph 100 illustrates one example injection event during which a fuel injector injects fuel into a combustion chamber of an internal combustion engine operated in accordance with a combustion cycle. In typical applications of fuel injectors, the time duration for the injection event may be very short, for example, approximately 3250 micro-seconds in the sample injection event shown. As can be appreciated, the voltage provided to the fuel injector during the illustrated example injection event is approximately 1000 volts.

In accordance with the present example, line 102 shows the voltage that is provided to the fuel injector, the voltage being switched off, and then back on repetitively, by the controller 4 during the early stage 104 of the injection event. Stated in another manner, the voltage that is provided to the fuel injector 10 by the power source 6 is modulated by the controller 4 between a predetermined first voltage and a predetermined second voltage, in this case, 1000 volts and 0 volts, respectively, the modulation rate of the power source 6 being faster than the response time of the nozzle valve element 20 to allow creation of a floating condition. In this regard, as previously noted, the power source 6 is operated so that voltage provided to the fuel injector 10 is preferably switched off and back on in less than 500 micro-seconds so that at least one cycle is attained in less than 500 micro-seconds. In the illustrated example of FIG. 3, the voltage provided to the fuel injector is switched off and back on in less than 250 microseconds, in particular, in approximately 200 micro-seconds.

As can be appreciated, when the voltage to the injector is turned off, the voltage to the piezoelectric fuel injector 10 decays to 0 in a short period of time to discharge the piezoelectric element of the fuel injector 10. After the modulation of the voltage that is provided to the fuel injector 10, a substantially constant voltage is provided to the fuel injector 10 in the steady state stage 105. The duration of the voltage that is provided to the fuel injector 10 corresponds to the amount of fuel injected, the amount depending on various engine operating conditions such as revolutions per minute, engine load, throttle position, etc.

Line 106 of graph 100 shows the injection rate corresponding to the voltage that is provided to the fuel injector 10 as shown by line 102. The dashed line 109 represents the injection rate when the full 1000 volts is provided to the fuel injector 10 continuously from the beginning of the injection event, without the cycling of the power provided during the early stage 104 in the manner described. As can be seen from line 109, the injection rate ramps up quickly to the steady state injection rate of approximately 50 $mm^3$/mSec. As previously described, this rapid ramp up in the injection rate, especially during the early stage of an injection event, causes increased emissions and decreased fuel economy.

In contrast, the line segment 107 shows the gradually increasing fuel injection rate that results when the voltage provided to the fuel injector 10 is modulated during the early stage 104 in the manner described. In particular, the injection rate gradually increases to the steady state injection rate of approximately 50 $mm^3$/mSec. as compared to the rapid ramp up of injection rate as shown by dashed line 109. By gradually increasing the injection rate, the emissions and fuel economy can be improved. Moreover, such gradual increase can be attained without attempting to variably control the magnitude of power that is provided to the fuel injector, which as previously noted, does not always provide corresponding control of the injection rate.

In practicing the present invention in the manner described above, the gradual increase in the fuel injection rate as shown in line segment 107 is caused by the fact that as the fuel injector 10 starts to respond to the provided voltage by beginning injection of fuel, the voltage to the fuel injector 10 is terminated to discharge the piezoelectric elements. This would cause rapid and continued reduction in the injection rate with eventual termination of injection of fuel. However, before the fuel injector 10 can fully terminate injection in response to the termination of the voltage, the voltage is switched back on so that the fuel injector 10 responds to the voltage that is provided again thereby resuming injection of fuel from the point where the injection rate has been reduced to. Correspondingly, the cycling of the fuel injector 10 at a rate faster than the response time of the nozzle valve element 20 creates a floating condition that allows gradual control of the injection rate of the fuel injector 10.

The above described cycling of the voltage provided to the fuel injector may cause some jaggedness in the injection rate as shown in the line segment 107 with minor peaks and valleys in the injection rate. The peaks of the injection rate loosely corresponds to the voltage cycles when the voltage to the fuel injector is switched back on except that the increase in the injection rate has a phase lag in which the peaks of the injection rate occurs slightly after the peaks of the voltage cycles due to the time required for the fuel injector to physically respond to the provided voltage. However, as clearly shown, if a straight line is best fitted to the data points that define the line segment 107 in the early stage 104 of the injection event, the slope of such a line is positive and gradually increasing.

Moreover, the magnitude of the voltage peaks of the cycles provided during the early stage of the injection event shown are substantially the same as the constant voltage that is provided during the steady state stage 105 of the injection event. The magnitude of the voltage provided to the fuel injector is dependent on the operational characteristics of the piezoelectric element 52 and the cycling frequency. In addition, the duration of the constant voltage provided during the steady state stage 105 which determines the amount of fuel that is injected is dependent on various operating conditions of the internal combustion engine.

Of course, as previously noted, the present invention may be used to control the rate at which the injection rate is decreased. In particular, within the injection event, the power provided to the fuel injector may be modulated from a steady state voltage to gradually decrease the injection rate. In this regard, the magnitude of the voltage provided during the cycles may be gradually decreased or the period in which the voltage is not provided may be gradually increased.

Thus, in contrast with the prior art which attempts to control the injection rate and the resulting rate shape by precisely controlling the magnitude of the injection signal provided to the fuel injector 10, the control of the injection rate and the resulting rate shape is attained in the present invention by modulating the power provided to the fuel injector 10 between a predetermined first voltage and a predetermined second voltage.

It should be understood that the above described implementation with respect to FIGS. 1 to 3 are merely example embodiments and the present invention is not limited thereto. Thus, whereas the predetermined second voltage is 0 in the example of FIG. 3, other embodiments may utilize a predetermined second voltage that is less than the predetermined first voltage but greater than 0 volts as previously described. In addition, in yet other embodiments, the predetermined second voltage may be a negative voltage, for example, approximately −20% of the predetermined first voltage. Such reduced or negative voltage may be used to modulate the fuel injector 10 so as to provide a gradual ramp up (or ramp down) of the injection rate in accordance with the present invention.

In addition, where as only three cycles are shown in the example of FIG. 3, other implementations may require higher number of cycles to attain the desired gradual change in the injection rate and may be used to gradually increase the injection rate or gradually decrease the injection rate. Furthermore, the cycles may be modified so as to provide different periods. Moreover, whereas in the illustrated example, the constant voltage provided during the steady state stage 105 is the same as the predetermined first voltage, it should be understood that constant, steady state voltage may be provided in other embodiments which differs from the first voltage. Finally, as previously noted, the present invention may be combined with other control strategies for controlling rate shape to provide further flexibility in controlling the rate shape such as a boot-shaped injection rate shape, a triangular injection rate shape, or any other desired injection rate shape.

Figure 4:
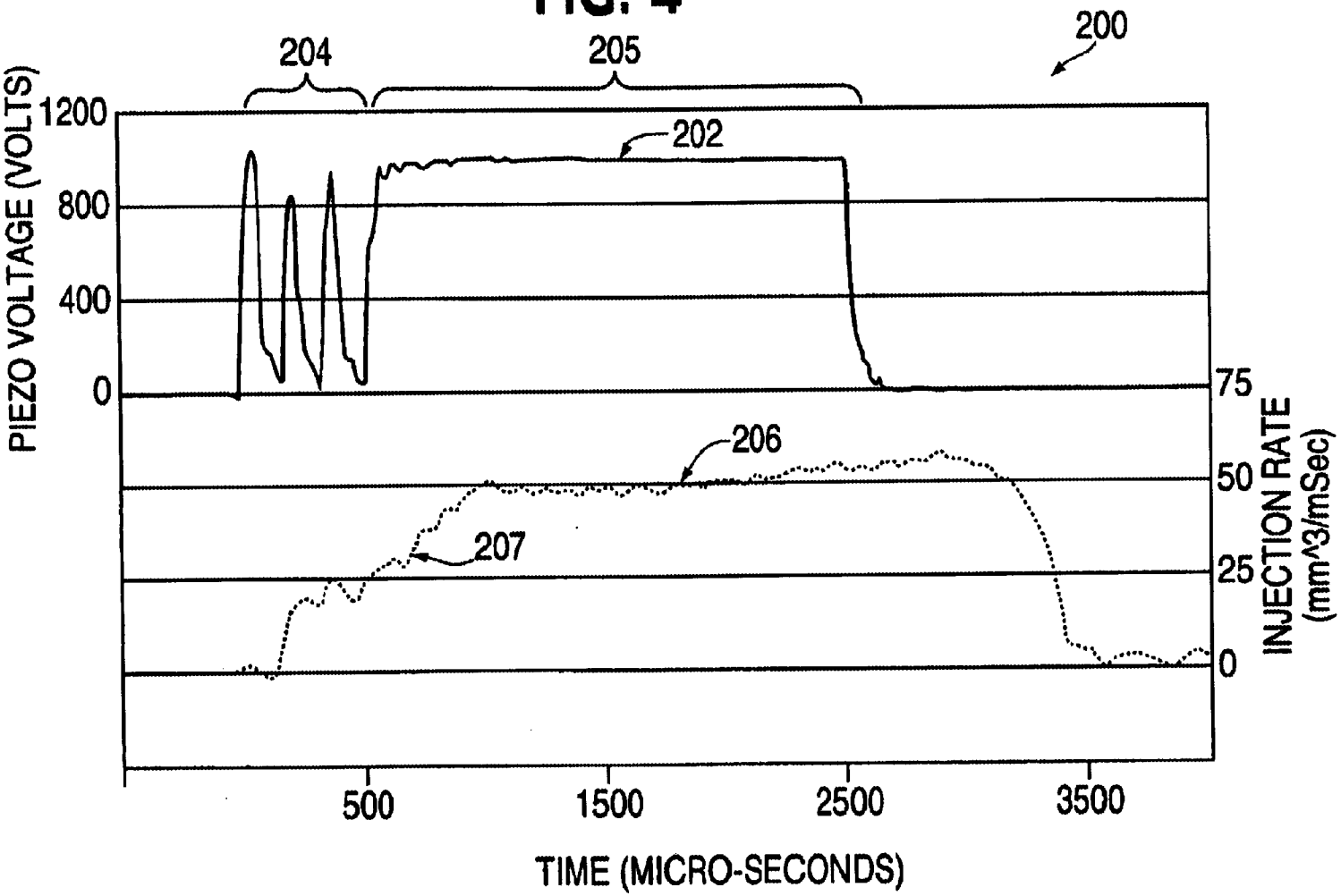
FIG. 4 is another graph illustrating voltage provided to a piezoelectric fuel injector, and the injection rate of the piezoelectric fuel injector, versus time duration for an example injection event.

Similar to the graph 100 of FIG. 3, FIG. 4 is another graph 200 illustrating the voltage applied to a piezoelectric fuel injector and the injection rate of the piezoelectric fuel injector, versus time duration for another example injection event. Line 202 illustrates the voltage provided to the fuel injector, the voltage being switched off, and then back on in a cyclic manner during the early stage 204 of the injection event. Thus, in the illustrated example, the voltage that is provided to the fuel injector is modulated between a predetermined first voltage and a predetermined second voltage, in this case, 1000 volts and 0 volts, respectively. After modulation of the voltage provided to the fuel injector, a substantially constant voltage at the predetermined first voltage of approximately 1000 volts is provided to the fuel injector in the steady state stage 205. As a result of the modulation of the voltage, the injection rate gradually increases to the steady state injection rate of approximately 50 $mm^3$/mSec as shown by the generally upwardly sloped line segment 207.

It should be noted that in the illustrated example, the voltage provided to the injector in the early stage 204 is shown as being slightly irregular with the initial peak voltage during the cycling being slightly greater than 1000 volts, and the second peak voltage being slightly less than 1000 volts. Such variation may occur due to the output variations of the power source providing the power to the fuel injector, the time period of each cycle being insufficient for the piezoelectric element to be fully charged/discharged, or the limitations of the controller 4 in precisely timing the cycles of repetitively switching the power source between the first and second voltages so that voltage is provided for exactly the same duration for each of the cycles.

Line 206 of graph 200 charts the injection rate corresponding to the voltage that is provided to the fuel injector as shown by line 202, the line segment 207 showing the gradually increasing fuel injection rate which results from modulating the voltage provided to the fuel injector in the manner described during the early stage 204. As previously described, the gradual increase in the fuel injection rate as shown in line segment 207 is caused by the fact that as the fuel injector begins to inject fuel in response to the provided voltage, the voltage is terminated and switched back on before the injector fully terminates injection so that the fuel injector resumes injection of fuel from the point where the injection rate has been reduced to.

It should again be noted that the graphs 100 and 200 of FIGS. 3 and 4 respectively, each merely show one example injection event for an example application and the present invention of modulating the power source to gradually increase or decrease injection rate may be practiced in injection events having additional fuel injection control strategies. In addition, the present invention may be equally applied to fuel injection control strategies that incorporate one or more pilot injection before the main injection event. Such pilot injections would occur prior to modulating the voltage provided to the fuel injector in the manner described.

Furthermore, whereas modulation/cycling of the power provided to the fuel injector was shown to occur in the early stage of the injection event (i.e. stages 104 and 204), the present method of controlling the injection rate may be applied to any stage of the injection event. For example, as noted, the modulation/cycling of the power to the fuel injector may be provided toward the end of the injection event to gradually decrease the injection rate.

Thus, it should be evident from the discussion above that in accordance with one aspect of the present invention, the piezoelectric fuel injection system 2 includes a controller 4 that is adapted to operate and control the fuel injector 10 in a cycling stage and a steady state stage. The voltage provided to the piezoelectric element 52 during the cycling stage of the injection event is repeatedly switched between a predetermined first voltage and a predetermined second voltage so that rate of injection by the fuel injector is gradually changed, for example, gradually increased or gradually decreased. In the steady state stage operation of the controller 4, power provided to the piezoelectric element 52 may be substantially steady at the predetermined first voltage, or another constant steady state voltage, so that rate of fuel injected by the fuel injector 10 is substantially constant.

In addition, it should now also be evident that in accordance with another aspect of the present invention, a method is provided for controlling a piezoelectric fuel injection system. As described above relative to the operation of the piezoelectric fuel injection system 2 of FIG. 1, the method comprises the steps of providing a voltage to a piezoelectric fuel injector to begin the injection event, terminating the voltage to the piezoelectric fuel injector so as to discharge the piezoelectric elements, again providing the voltage to the piezoelectric fuel injector, and repeatedly terminating and providing the voltage to the piezoelectric fuel injector during at least a portion of the injection event in a manner that rate shape of fuel injected by the piezoelectric fuel injector during the portion of the injection event changes gradually, for example, gradually increases. The repeated termination and providing of the voltage is attained at a rate faster than the response time of the nozzle valve element. Of course, as previously noted, the present invention would also include a method in which the rate shape is gradually decreased via the cycling of the voltage. By repeatedly cycling the voltage, the rate of injection changes more slowly than if the voltage is not cycled.

In addition, it should also be evident that the method may also include the step of continuously providing the voltage to the piezoelectric fuel injector after the step of repeatedly terminating and providing the voltage to the piezoelectric fuel injector so that the piezoelectric fuel injector injects fuel at a substantially constant rate. The step of terminating the voltage to the piezoelectric fuel injector is attained in less than 500 micro-seconds of providing the voltage in one embodiment, and preferably within less than 250 micro-seconds.

Of course, it should also be evident that in accordance with another embodiment, a method of controlling a piezoelectric fuel injection system is provided in which voltage to the piezoelectric fuel injector is cyclically modulated between a predetermined first voltage and a predetermined second voltage to thereby control injection rate of fuel injected by the piezoelectric fuel injector.

While various embodiments in accordance with the present invention have been and described, it is understood that the invention is not limited thereto. The present invention may be changed, modified and further applied by those skilled in the art. Therefore, this invention is not limited to the detail shown and described previously, but also includes all such changes and modifications.

We claim:

1. A piezoelectric fuel injection system for an internal combustion engine, said piezoelectric fuel injection system being adapted to allow injection of fuel during an injection event, said piezoelectric fuel injection system comprising:

a piezoelectric element actuable to inject fuel during said injection event;

a power source adapted to provide power to said piezoelectric element; and a controller adapted to switch said power source on to begin said injection event, and to cycle said power source a plurality of times during at least a portion of said injection event, each cycle including switching said power source off, and switching said power source back on to thereby provide cyclical power to said piezoelectric element during said portion of said injection event to control the rate of injected fuel during said portion of said injection event.

2. The system of claim 1, wherein rate of injected fuel during said portion of said injection event is one of gradually increased and gradually decreased as a result of said cycling of said power source.

3. The system of claim 1, wherein said controller is further adapted to terminate cycling of said power source.

4. The system of claim 3, wherein said controller is adapted to terminate cycling of said power source with said power source switched back on so as to provide constant power to said piezoelectric element for a duration so that rate of injected fuel is substantially constant for said duration.

5. The system of claim 1, wherein said portion of said injection event during which said power source is cycled plurality of times by said controller is at an early stage of said injection event.

6. The system of claim 1, wherein said controller is further adapted to switch said power source off and back on in less than 500 micro-seconds so that at least one cycle is attained in less than 500 micro-seconds.

7. The system of claim 1, further comprising a nozzle valve element having a response time, wherein said controller is adapted to switch said power source off and back on at a rate that is faster than said response time of said nozzle valve element.

8. A piezoelectric fuel injection system for an internal combustion engine, said piezoelectric fuel injection system being adapted inject fuel during an injection event of a combustion cycle, said piezoelectric fuel injection system comprising:

a piezoelectric fuel injector actuable to inject fuel during said injection event, said piezoelectric fuel injector having a piezoelectric element;

a power source adapted to provide power to said piezoelectric element to actuate said piezoelectric fuel injector; and a controller adapted to cyclically modulate power provided to said piezoelectric element by said power source during at least a portion of said injection event, said controller cyclically modulating said power between a predetermined first voltage and a predetermined second voltage that is less than said first voltage to control the rate of fuel injected by said piezoelectric fuel injector during said portion of said injection event.

9. The system of claim 8, wherein rate of injected fuel during said portion of said injection event is one of gradually increased and gradually decreased as a result of said cyclic modulation of said power.

10. The system of claim 8, wherein said predetermined second voltage is approximately zero volts.

11. The system of claim 8, wherein said controller is further adapted to terminate cyclic modulation of said voltage.

12. The system of claim 11, wherein said controller is adapted to terminate cyclic modulation of said voltage at said predetermined first voltage to provide continued power to said piezoelectric element at said predetermined first voltage so that said piezoelectric fuel injector injects fuel at a substantially constant rate.

13. The system of claim 8, wherein said portion of said injection event during which said controller cyclically modulates said voltage to said piezoelectric element is at an early stage of said injection event.

14. The system of claim 8, wherein said controller is further adapted to modulate power between said predetermined first voltage and said predetermined second voltage in less than 500 micro-seconds.

15. The system of claim 8, further comprising a nozzle valve element having a response time, wherein said controller is adapted to switch said power source off and back on at a rate that is faster than said response time of said nozzle valve element.

16. A method of controlling a piezoelectric fuel injection system for an internal combustion engine having a piezoelectric fuel injector adapted to inject fuel during an injection event of a combustion cycle, said method comprising the steps of:

providing a voltage to said piezoelectric fuel injector to begin said injection event;

terminating said voltage to said piezoelectric fuel injector;

again providing said voltage to said piezoelectric fuel injector; and repeatedly terminating and providing said voltage to said piezoelectric fuel injector during at least a portion of said injection event to control rate of fuel injected by said piezoelectric fuel injector during said portion of said injection event.

17. The method of claim 16, wherein rate of injected fuel during said portion of said injection event is one of gradually increased and gradually decreased as a result of repeatedly terminating and providing said voltage to said piezoelectric fuel injector.

18. The method of claim 16, further including the step of continuously providing said voltage to said piezoelectric fuel injector during said injection event after said step of repeatedly terminating and providing said voltage to said piezoelectric fuel injector so that said piezoelectric fuel injector injects fuel at a substantially constant rate.

19. The method of claim 16, wherein said portion of said injection event during which said step of repeatedly terminating and providing said voltage to said piezoelectric fuel injector is at an early stage of said injection event.

20. The method of claim 16, wherein said step of repeatedly terminating and providing said voltage to said piezoelectric fuel injector includes the step of terminating said voltage within less than 500 micro-seconds of providing said voltage.

21. The method of claim 16, wherein said piezoelectric fuel injector includes a nozzle valve element having a response time, and said step of repeatedly terminating and providing said voltage to said piezoelectric fuel injector is attained at a rate that is faster than said response time of said nozzle valve element.

22. A method of controlling a piezoelectric fuel injection system for an internal combustion engine having a piezoelectric fuel injector during an injection event of a combustion cycle, said method comprising the steps of:

providing a voltage to said piezoelectric fuel injector; and cyclically modulating said voltage that is provided to said piezoelectric fuel injector between a predetermined first voltage and a predetermined second voltage during at least a portion of said injection event to thereby control rate of fuel injected by said piezoelectric fuel injector during said portion of said injection event.

23. The system of claim 22, wherein rate of injected fuel during said portion of said injection event is one of gradually increased and gradually decreased as a result of said step of cyclically modulating said voltage.

24. The method of claim 23, wherein said predetermined second voltage is less than said predetermined first voltage.

25. The method of claim 24, wherein said predetermined second voltage is substantially zero volts.

26. The method of claim 23, further including the step of terminating said step of cyclically modulating said voltage.

27. The method of claim 26, further including the step of continually providing said predetermined first voltage to said piezoelectric fuel injector after terminating said step of cyclically modulating said voltage so that rate of fuel injected by said piezoelectric fuel injector is substantially constant.

28. The method of claim 22, wherein said portion of said injection event during which said step of modulating said voltage provided to said piezoelectric fuel injector is at an early stage of said injection event.

29. The method of claim 22, wherein at least one cycle in said step of cyclically modulating said voltage provided to said piezoelectric fuel injector is attained in less than 500 micro-seconds.

30. The method of claim 22, wherein said piezoelectric fuel injector includes a nozzle valve element having a response time, and said step of repeatedly terminating and providing said voltage to said piezoelectric fuel injector is attained at a rate that is faster than said response time of said nozzle valve element.

31. A piezoelectric fuel injection system for an internal combustion engine, said piezoelectric fuel injection system comprising:

a fuel injector actuable to inject fuel during an injection event, said fuel injector having a piezoelectric element; and a controller adapted to operate said fuel injector in:

a cycling stage in which power provided to said piezoelectric element during at least a portion of said injection event is repeatedly switched between a predetermined first voltage and a predetermined second voltage less than said first voltage to control the rate of fuel injected by said fuel injector; and a steady state stage in which power provided to said piezoelectric element is substantially steady at said predetermined first voltage so that rate of fuel injected by said fuel injector is substantially constant.

32. The system of claim 31, wherein rate of injected fuel during said portion of said injection event is one of gradually increased and gradually decreased during said cycling stage.

33. The system of claim 31, wherein said predetermined second voltage is approximately zero volts.

34. The system of claim 31, wherein said controller is further adapted to switch power to said piezoelectric element between said predetermined first voltage and said predetermined second voltage in said cycling stage in less than 500 micro-seconds.

35. The system of claim 31, wherein said controller operates said fuel injector in said cycling stage before said steady state stage.

* * * * *